US005384851A

United States Patent [19]

Fujimori

[11] Patent Number: 5,384,851

[45] Date of Patent: Jan. 24, 1995

[54] METHOD AND APPARATUS FOR CONTROLLING SOUND LOCALIZATION

[75] Inventor: Junichi Fujimori, Hamamatsu, Japan

[73] Assignee: Yamaha Corporation, Japan

[21] Appl. No.: 226,261

[22] Filed: Apr. 11, 1994

Related U.S. Application Data

[63] Continuation of Ser. No. 773,031, Oct. 8, 1991, abandoned.

[30] Foreign Application Priority Data

Oct. 11, 1990 [JP] Japan ..... 2-272727

[51] Int. Cl.[6] ..... H04S 5/00

[52] U.S. Cl. ..... 381/17

[58] Field of Search ..... 381/1, 17, 63

[56] References Cited

U.S. PATENT DOCUMENTS

| | | | |
|---|---|---|---|
| 4,118,599 | 10/1978 | Iwahara et al. . | |
| 4,188,504 | 2/1980 | Kasuga et al. . | |
| 4,192,969 | 3/1980 | Iwahara | 381/1 |
| 4,219,696 | 8/1980 | Kogure et al. . | |
| 4,817,149 | 3/1989 | Myers . | |
| 4,980,914 | 12/1990 | Kunungi et al. | 381/1 |
| 5,046,097 | 9/1991 | Lowe et al. . | |
| 5,105,462 | 4/1992 | Lowe et al. . | |

*Primary Examiner*—Forester W. Isen
*Attorney, Agent, or Firm*—Graham & James

[57] ABSTRACT

A sound localization control apparatus controls localization of sound which is perceived by listeners by carrying out a signal processing on left and right channels binaural audio signals supplied thereto and supplying the resulting signals to left and right loudspeakers. In the apparatus, a matrix, determined based on a transfer function from the loudspeakers to left and right ears of the listener, is multiplied to the left and right channels audio signals. In order to determine the matrix, the matrix is determined for account of four paths including the two noncrossing main paths formed between the loudspeakers and the left and right ears of the listener and the remaining two "cross-talk" paths cross each other. In the case where a difference in delay time T exists between transmitting a sound through a main path and transmitting a sound through a cross-talk path, and the ratio between the amount of attenuation for transmitting a sound through a main path and the amount on attenuation for transmitting a sound through a cross-talk path is k, and a delay operator for performing a delay function of delay time T is defined as $z^{-T}$, then the matrix is defined as follows:

$$\frac{1}{1-k^2 * z^{-2t}}\begin{bmatrix} 1 & -k * z^{-T} \\ -k * z^{-T} & 1 \end{bmatrix}$$

The sound localization control apparatus carries out a pre-process of the input binaural signal so that cross-talk components signal is canceled.

9 Claims, 2 Drawing Sheets

METHOD AND APPARATUS FOR CONTROLLING SOUND LOCALIZATION

This is a continuation of copending application Ser. No. 07/773,031 filed on Oct. 8, 1991 now abandoned.

BACKGROUND OF THE INVENTION

1. Field of the Invention

The present invention relates to a sound localization control apparatus and method for controlling localization of sound image, i.e., localization of sound sources as perceived by the human ear.

2. Prior Art

Recently, there has been renewed interest in a technique known as the "binaural sound" technique which recreates for the listener a real and dynamic stereo sound image. The reason for this renewed interest in the binaural technique is due to its enormous potential for application in large screen television and "virtual reality". The binaural technique has been made possible through the recent development of digital signal processing.

In the sound reproduction of binaural signals, headphones are generally used. The use of headphones is generally accepted due to the wide use of the headphone stereo. However, as will be described below, there are cases in which listeners prefer to listen to the reproduction of sound through the use of loudspeakers.

In the case where binaural signals are reproduced through two loudspeakers positioned at the left side and right sides of a listener, the sound emanating from one of the loudspeakers propagates to the left and right ears whereby a "cross-talk" phenomena is established. There is a problem in that the listener cannot perceive the localization of sound image of the original sound expressed in the binaural signals due to the effect of cross-talk. In order to overcome this problem, a method is proposed in which a pre-process is carried out on the binaural signals to be reproduced; and the results of the pre-process are reproduced through the left and right sides loudspeakers to cancel the effect of cross-talk. Hereinafter, a detailed description of the method will be given.

In a general listening room, there are many reflection sounds and the model for reviewing the method is quite complex. For this reason, the description will be given with respect to the model of sound reproduction in a non-reverberation room. In the case where sounds are emanated from two loudspeakers positioned at the left and right sides of a listener in the non-reverberation room, the sound transmission, in Which the sound emanates from the left and right loudspeakers and propagates to the left and right ears of the listener, is simulated by the model shown in FIG. 6.

In FIG. 6, Hrr designates a transfer function of a sound transmission path through which sound R, emanated from right loudspeaker 1, propagates to right ear 3; Hrl designates a transfer function of a sound transmission path through which sound R, emanated from right loudspeaker 1, propagates to left ear 4; Hlr designates a transfer function of a sound transmission path through which sound L, emanated from left loudspeaker 2, propagates to right ear 3; Hll designates a transfer function of a sound transmission path through which sound L, emanated from left loudspeaker 2, propagates to left ear 4. Hereinafter, the sound transmitting from right loudspeaker 1 to left ear 4, and the sound transmitting from left loudspeaker 2 to right ear 3, will be called "cross-talk components".

In this model, sound ER perceived by right ear 3 and sound EL perceived by left ear 4 are described by using the following formula (1).

$$\begin{bmatrix} ER \\ EL \end{bmatrix} = \begin{bmatrix} Hrr & Hlr \\ Hrl & Hll \end{bmatrix} \begin{bmatrix} R \\ L \end{bmatrix} \tag{1}$$

In the case where the listener is positioned in front of both loudspeakers such that the transfer function between listener and right loudspeaker, and the transfer function between listener and left loudspeaker, can be regarded as symmetrical, the following formulae can be used.

$$S = Hrr = Hll \tag{2}$$

$$A = Hrl = Hlr \tag{3}$$

The above formula (1) can be rewritten by using above formulae (2) and (3) in the following manner:

$$\begin{bmatrix} ER \\ EL \end{bmatrix} = \begin{bmatrix} S & A \\ A & S \end{bmatrix} \begin{bmatrix} R \\ L \end{bmatrix} = \begin{bmatrix} S*R + A*L \\ A*R + S*L \end{bmatrix} \tag{4}$$

In the case where matrix $$\begin{bmatrix} S & A \\ A & S \end{bmatrix}$$

is a regular matrix, there exists a inverse matrix of the regular matrix which is described using formula (5).

$$\begin{bmatrix} S & A \\ A & S \end{bmatrix}^{-1} = \frac{1}{S*S - A*A} \begin{bmatrix} S & -A \\ -A & S \end{bmatrix} \tag{5}$$

If the pre-process corresponding to the inverse matrix as thus obtained is carried out on both left and right channels of audio signals to be reproduced and the processed signals are supplied to the left and right loudspeakers, the transfer function matrix corresponding to the total path through which the left and right channels of audio signals transmit to the left and right ears of the listener is described as follows:

$$\begin{bmatrix} S & A \\ A & S \end{bmatrix}^{-1} \begin{bmatrix} S & A \\ A & S \end{bmatrix} = \begin{bmatrix} 1 & 0 \\ 0 & 1 \end{bmatrix} \tag{6}$$

In this manner, cross-talk components can be canceled and the left and right channels of audio signals are respectively transmitted to the left and right ears without interference of one channel sound to the other.

Next, data C defined by the following formula is introduced.

$$C = A/S \tag{7}$$

In this case, the following formula can be used in order to vary formula (5).

$$\frac{S}{S^2 - A^2} = \frac{1}{S} \cdot \frac{1}{1 - C^2} \tag{8}$$

$$\frac{-A}{S^2 - A^2} = \frac{-C}{S} \cdot \frac{1}{1 - C^2} \tag{9}$$

The following formula (10) is obtained by applying formulae (8) and (9) to formula (5).

$$\begin{bmatrix} 1 & -C \\ -C & 1 \end{bmatrix} \begin{bmatrix} 1/\{S*(1 - C^2)\} & 0 \\ 0 & 1/\{S*(1 - C^2)\} \end{bmatrix} \tag{10}$$

This formula is known as Schroeder's model. The filter which performs the signal processing expressed by the inverse matrix (10) can be obtained by first measuring the transfer functions S and A of the sound transmission path, and then by calculating the value of C and 1/S based on the measurements of S and A. The desirable sound transfer function can be obtained by using the previously obtained filter since the sound transfer function between the loudspeakers and the head of the listener, which generates the cross-talk, can be corrected.

However, it is generally difficult to design a filter, which corrects the transfer function of a target system, corresponding to the inverse matrix of the transfer function matrix of the system, based on the impulse response measurement obtained from the system. Even if the design is possible, an FIR (Finite Impulse Response) filter having more than ten taps is necessary.

SUMMARY OF THE INVENTION

It is an object of the present invention to provide a compact, sound localization control apparatus for correcting the sound transmitting function of a target sound transmission system, which is also capable of controlling the "cross talk component" through simple parameter manipulation.

By applying signal processing to the left and right channel audio signals generated by a sound source, and then by supplying the resulting signals to the left and right loudspeakers, the present invention is able to effectively control sound interference. This signal processing involves multiplication of a matrix which is determined based on the transfer function between the loudspeakers and the ears of the listener. Thus, the signal processing involves a total of four paths: the two noncrossing paths formed between the left and right loudspeakers and the left and right ears are defined as main paths, while the remaining two paths cross each other and are defined as "cross talk" paths. In the case where a difference in delay time T, exists between transmitting a sound through a main path and transmitting a sound through a cross-talk path, and the ratio between the amount of attenuation for transmitting a sound through a main path and the amount of attenuation for transmitting a sound through a cross-talk path is designated by k, and a delay operator for performing a delay function of delay time T is defined as $z^{-T}$, then the matrix is defined as follows:

$$\frac{1}{1 - k^2 * z^{-2T}} \begin{bmatrix} 1 & -k*z^{-T} \\ -k*z^{-T} & 1 \end{bmatrix}$$

In the above situation, if the transfer function is defined by a first matrix as, $$\begin{bmatrix} 1 & k*z^{T} \\ k*z^{T} & 1 \end{bmatrix}$$

then the matrix to be multiplied to the audio signals is defined by the following second matrix:

$$\frac{1}{1 - m^2 * z^{-2T}} \begin{bmatrix} 1 + i*z^{-2T} & -j*z^{-T} \\ -j*z^{-T} & 1 + i*z^{-2T} \end{bmatrix}$$

Parameters i, j and m are controlled so that when the second matrix is multiplied with the first matrix, the first row and first column element as well as the second row and second column element of the resulting matrix both equal one.

By employing the first described sound localization control apparatus in front of the loudspeakers, the transfer function between a sound source generating the left and right channel audio signals, and the left and right ears, is defined as a unit matrix as follows whereby cross-talk components can be canceled.

$$\begin{bmatrix} 1 & 0 \\ 0 & 1 \end{bmatrix}$$

By employing the second described sound localization control apparatus in front of the loudspeakers, the transfer function between a sound source generating the left and right channel audio signals and the left and right ears is defined as the following matrix:

$$\begin{bmatrix} 1 & a \\ a & 1 \end{bmatrix}$$

In the above matrix, the element a is controlled by adjusting parameters i, j and m whereby cross-talk components can be controlled.

The other features of this invention will now be explained in the following description with reference to the accompanying drawings.

DESCRIPTION OF PREFERRED EMBODIMENTS

First Preferred Embodiment

Figure 1:
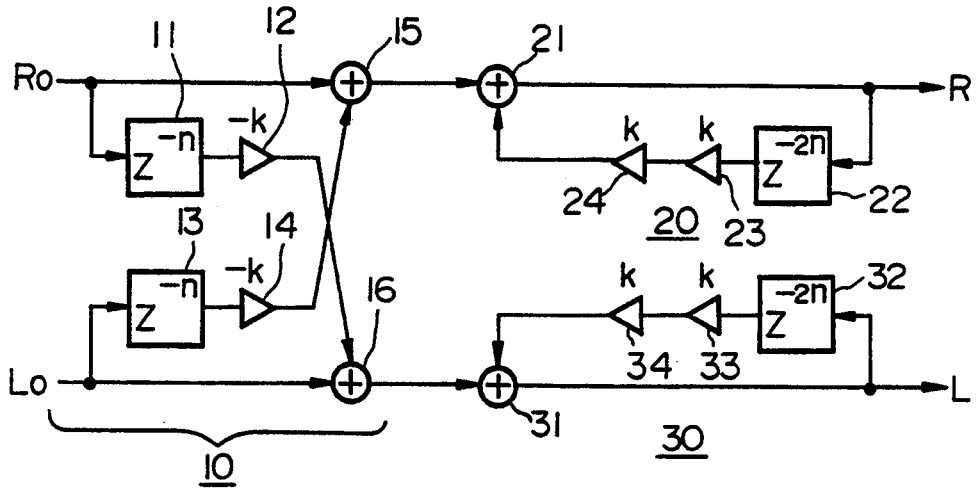
FIG. 1 is a block diagram showing a configuration of a sound localization control apparatus according to the first preferred embodiment of the present invention.
Figure 2:
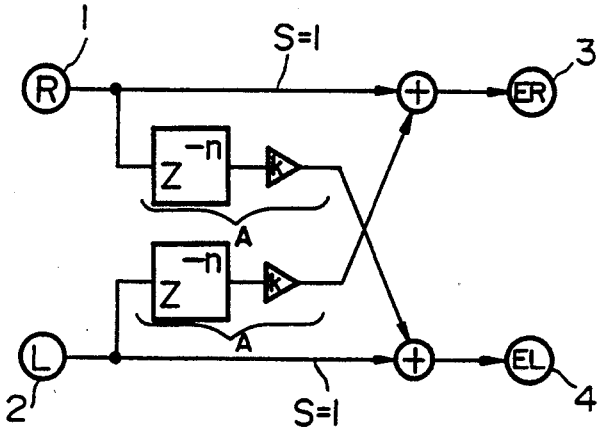
FIG. 2 shows an electric model of sound transfer function between left and right loudspeakers and left and right ears of a listener according to the first preferred embodiment of the invention.

FIG. 1 is a block diagram showing a configuration of a sound localization control apparatus according to the first preferred embodiment of the present invention. In this preferred embodiment, the sound transmission path, through which the sound emanating from the left and right loudspeakers transmits to the left and right ears of the listener, is simulated as shown in FIG. 2. In FIG. 2, the path between right loudspeaker 1 and right ear 3 of the listener is defined as a first main path. The path between left loudspeaker 2 and left ear 4 of the listener is defined as a second main path. The transfer function S corresponding to first and second main paths is defined as [1]. In addition, the path between right loudspeaker 1 and left ear 4 of the listener is defined as a first cross-talk path. The path between left loudspeaker 2 and right ear 3 of the listener is defined as a second cross-talk path. Each of the transfer function A corresponding to first and second cross-talk paths is defined by the following formula (11).

$$A=k*z^{-n} \tag{11}$$

In the above formula (11), k is the ratio of the sound attenuation value of the cross-talk path to that of the main path. In addition, $z^{-n}$ is the delay time corresponding to the difference between the propagation delay time required for transmitting sound through the main path and the propagation delay time required for transmitting sound through the cross-talk path. The element corresponding to $z^{-n}$ is a delay circuit, which can be achieved by using, for example, an "n-stage" shift register triggered by a sampling clock having a constant sampling period.

Hereinafter, the designing of the stage number n of the delay circuit and the ratio k will be given.

Figure 3:
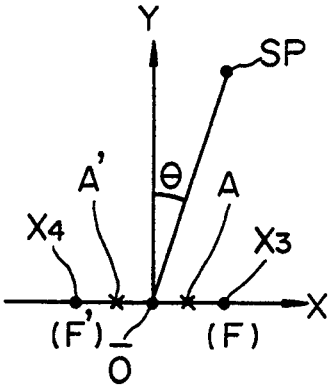
FIG. 3 shows the position of a pair of loudspeakers SP and a positions of the listener's ears.

Suppose the condition as shown in FIG. 3, in which the center point of the listener's head is positioned at a point O; the left and right ears of the listener are positioned at points $X_4$ and $X_3$ on the X-axis; and the left and right loudspeakers are positioned at a point SP displaced by r along an axis which passes through the point O and has an angle $\theta$ with the Y-axis. Additionally, in this embodiment, the distances between the center point and the left and right ears, ABS($O-X_4$) and ABS($O-X_3$), which designate the absolute value of ($O-X_4$) and ($O-X_3$), can be regarded as equal, thus ABS($O-X_4$)=ABS($O-X_3$)=e. In this case, the difference d between the distance ABS($SP-X_4$) from loudspeakers to the left ear and the distance ABS($SP-X_3$) from the loudspeakers to the right ear is calculated by the following formula (12).

$$d=ABS(SP-X_4)-ABS(SP-X_3)=\{(r*\sin\theta+e)^2+(r*\cos\theta)^2\}^{\frac{1}{2}}-\{(r*\sin\theta-e)^2+(r*\cos\theta)^2\}^{\frac{1}{2}} \tag{12}$$

In the case where the sound velocity in air is v and the frequency of the sampling clock triggering the shift register is fs, the stage number n of the shift register is calculated by the following formula (13).

$$n=d/(v*fs) \tag{13}$$

For example, when v=330 m/sec, fs=48 kHz, r=1.5 m and $\theta$=30 deg are set as data, the distance d=0.07 m and the stage number n=10 are calculated by the above method.

Coefficient k is determined as a sound pressure ratio which is the ratio between the pressure of the sound transmitted to the ears through the main path, and the pressure of the sound transmitted to the ears through the cross-talk path. Generally, when the intensity of a sound source generating a spherical surface sound wave equals A $m^3$/sec, the angular frequency of the sound is $\omega$ rad/sec, the density of the medium of sound is $\rho$ kg/$m^3$, and the wavelength constant of sound is h rad/m, then the sound pressure p, at a point which is displaced by the distance r from the sound source, can be calculated using the following formula:

$$p=\{(\omega*\rho*A/4*\omega*r)\}\cos(\omega*t-h*r) \tag{14}$$

Accordingly, the sound pressure ratio between the sound pressure P, at the point displaced by the distance r from the loudspeakers, and the sound pressure P', at the point displaced by the distance r' from the loudspeakers, is calculated by the following formula.

$$P/P'=\{r*\cos(\omega*t-h*r)\}/\{r'*\cos(\omega*t-h*r')\} \tag{15}$$

In the case where a spherical surface sound wave is emanated from the sound source, sound pressure ratio P/P' should be determined based on r/r'. However, when an experiment was performed in order to measure the sound pressure ratio, the results obtained indicated that the measured sound pressure was about one half of the pressure calculated based on r and r'. This result was possibly due to the fact that the sound wave emanating from the sound source was not a complete spherical surface sound wave as well as the fact that there was disturbance caused by the head of the listener. In order to create a sound localization control apparatus capable of correcting the cross-talk, it is desired that the actual measured sound pressure ratio is used as the coefficient k.

In this manner, delay stage number n and coefficient k are obtained. The sound localization control apparatus capable of canceling cross-talk components is designed using the parameters n and k as follows.

First, S=1 and C=A/S=$k*z^{-n}$ are applied to the above shown formula (10). As a result, a matrix required for canceling cross-talks is obtained as indicated in the following formula (16).

$$\begin{bmatrix} 1 & -k*z^{-n} \\ -k*z^{-n} & 1 \end{bmatrix}\begin{bmatrix} 1/(1-k*k*z^{-2n}) & 0 \\ 0 & 1/(1-k*k*z^{-2n}) \end{bmatrix} \tag{16}$$

The apparatus shown in FIG. 1 performs the signal processing corresponding to the matrix (16). In FIG. 1, a lattice circuit 10 is provided for carrying out the signal processing corresponding to the first portion (shown in left) of matrix (16). This lattice circuit 10 provides n stage delay circuits 11 and 13 for delaying right and-left channel audio signals $R_0$ and $L_0$, as well as multipliers 12 and 14 for multiplying the output signals from delay circuits 11 and 13 by the coefficient −k. Adder 15, for adding right channel audio signal $R_0$ and the output signal of multiplier 14, and an adder 16, for adding left channel audio signal $L_0$ with the output signal of multiplier 12, are also included. Loop circuit 20 is provided for carrying out the signal processing corresponding to the first row and first column element of the second matrix (shown in right) of matrix (16), while loop circuit 30 is provided for carrying out the signal processing corresponding to the second row and second column element of the second matrix. Loop circuit 20 provides an adder 21 for inputting the output signal of adder 15 through its first input terminal, a 2n stage delay circuit 22 for delaying the output signal of adder 21, a multiplier 23 for multiplying the output signal of delay circuit 22 by coefficient k, and a multiplier 24 for multiplying the output signal of multiplier 23 by coefficient k and for supplying the resulting signal to second input terminal of adder 21. Loop circuit 30 provides an adder 31, a 2n stage delay circuit 32, multipliers 33 and 34 which are connected in a similar fashion.

In the case where the sound localization control apparatus shown in FIG. 1 is connected to the input terminals of the left and right loudspeakers, left and right channel audio signals $L_0$ and $R_0$ are transmitted respectively to the left and right ears independently without interference.

In an experiment corresponding to the configuration depicted in FIG. 1, a program for executing the signal processing was designed in which k=0.5, and n=10 and then programmed into a Digital Signal Processor (DSP). In the experiment, left and right channel sound signal $L_0$ and $R_0$ were processed by the DSP, and the output signals of the DSP were supplied to the left and right loudspeakers. As a result, no cross-talk was observed, and the left and right channel sounds were reproduced so that the left channel sound occurred in the vicinity of the left ear and the right channel sound occurred in the vicinity of the right ear.

In the case where n is a fixed a constant in the apparatus of FIG. 1, cross-talk is canceled when the loudspeaker is positioned at any point which satisfies a condition in which the difference between the distance from the right ear to the point and the distance from the left ear to the point equals a constant corresponding to the stage number n. The points which satisfy the condition constitute a hyperbola. In FIG. 3, focus points F and F′ of the hyperbola are positioned at positions $X_3$ and $X_4$ which correspond to the positions of the right and left ears of the listener. Accordingly, when the loudspeaker is placed at any point on the hyperbola, cross-talk can be canceled.

Hereinafter, a hyperbola satisfying the condition capable of canceling cross-talk will be calculated based on the design example of the sound localization control apparatus shown in FIG. 1. Generally, any point (x,y) on a hyperbola satisfies the following formula (17).

$$(x/a)^2-(y/b)^2=1 \quad (17)$$

Formula (17) can be rewritten as formula (18) below.

$$y=\pm(b/a)*(x^2-a^2)^{\frac{1}{2}} \quad (18)$$

In formulae (17) and (18), constant a is determined by the following formula (19).

$$a=0A=0A' \quad (19)$$

In formula (19), 0 is the zero point of the x and y axises; A and A′ are the points at which the hyperbola crosses the x-axis, as shown in FIG. 3. Furthermore, the following formula (20) is applicable.

$$e=0F=0F'=(a^2-b^2)^{\frac{1}{2}} \quad (20)$$

In formula (20), e is the distance from the center of the listener's head to the left or right ear of the listener. Point SP on the hyperbola satisfies the condition in which the difference between the distance from focus point F to point SP, and the distance from focus point F′ from to point SP equal 2a. In order to cancel cross-talk, the distance d, corresponding to the delay stage number n of the sound localization control apparatus, must equal 2a. Cross-talk is canceled in the case where the following formula (21) is satisfied, obtained by applying a=d/2 to the formula (20).

$$b=\{e^2-(d/2)^2\}^{\frac{1}{2}} \quad (21)$$

For example, if e=0.07 m, d=0.07 m, (corresponding to n=10), then a=0.035 m b=0.078 m In this case, cross-talk can be canceled by placing the loudspeaker at the point on the hyperbola $(X/0.035)^2-(y/0.078)^2=1$ and choosing the proper coefficient k appropriate. The asymptotic curve of the hyperbola is thus described by $y=\pm(-b/a)x=\pm(0.078/0.035)x$, at an angle of about 24° with the x-axis. When the distance between the head of the listener and the loudspeakers is more than 0.5 m, it can be regarded that the positions of the loudspeakers which cancel cross-talk are on the asymptotic curve. Generally, when calculating the delay time for the transmission of sound between left and right ears, only the angle between the frontal directional line and the line on which the loudspeakers are positioned, should be considered.

Figure 4:
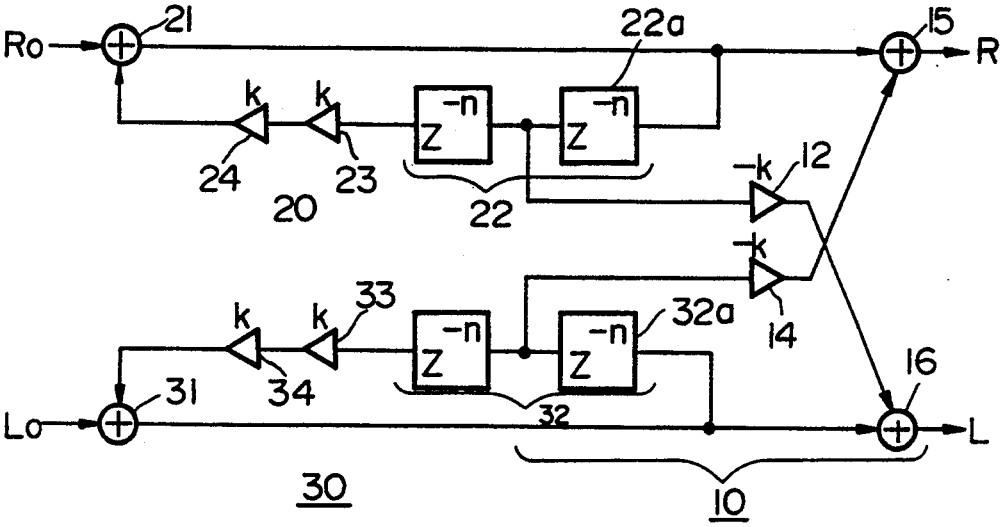
FIG. 4 is a block diagram showing a configuration of a modification for the first preferred embodiment.

FIG. 4 shows the configuration of a modified embodiment of the first preferred embodiment. In formula (16), even if the positions of the first and second matrixes are exchanged (i,e, the multiplication direction of the two matrixes are inverted), a unit matrix can be still obtained as a result of the multiplication. According to this, the position of lattice circuit 10 and the positions of loop circuits 20 and 30 are exchanged as shown in FIG. 4. The same signal processing performed in the configuration shown in FIG. 1 is also performed in the configuration described in FIG. 4. However, in the configuration shown in FIG. 4, the signal to be supplied to multipliers 12 and 14 is obtained from the intermediate leads of delay circuits 22 and 32; these leads are the output terminals of the primary delay circuits 22*a* and 32*a* (having delay stage number n), thus the delay circuits 11 and 12 shown in FIG. 1 can be omitted.

In the above-described preferred embodiments, in the case of k=0.5, the multipliers can replace the shift operator, thus reducing the amount of calculation. In addition, the sound localization control apparatus cannot only be considered as a digital circuit, but as an analog circuit as well.

Second Preferred Embodiment

Figure 5:
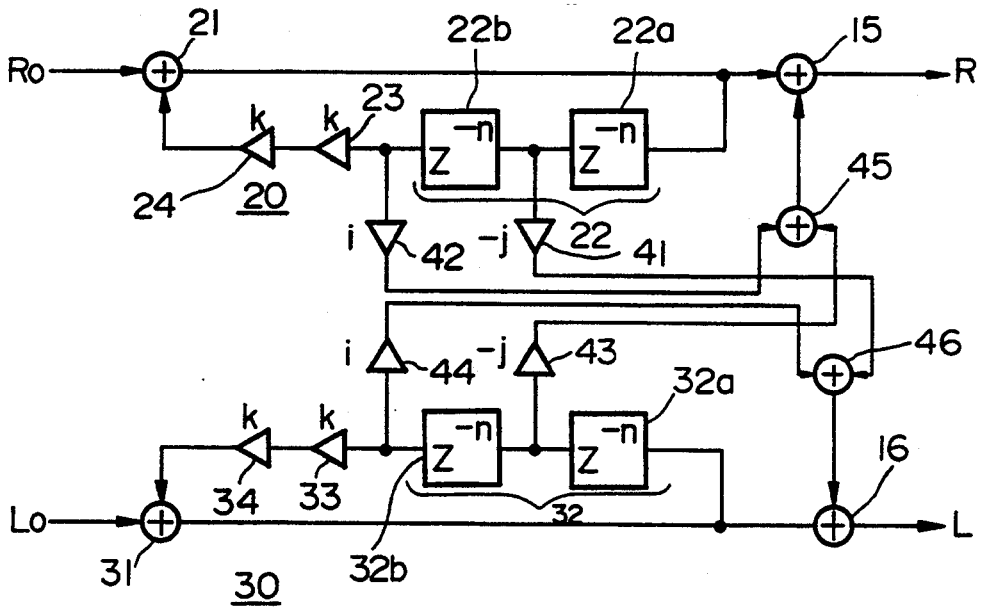
FIG. 5 is a block diagram showing a configuration of a sound localization control apparatus according to the second preferred embodiment of the present invention.
Figure 6:
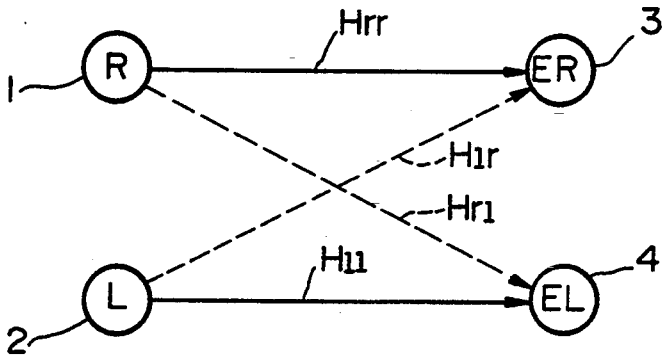
FIG. 6 shows a model of sound transfer function between left and right loudspeakers and left and right ears of the listener.

FIG. 5 shows the configuration of a sound localization control apparatus according to the second preferred embodiment of the present invention. In this embodiment, the cross-talk components transmitted to the left and right ears respectively, can be adjusted so that the position of the sound source perceived by the listener can be frequently changed from the location of the loudspeakers to the vicinity of the ears. Hereinafter, the control method of the embodiment will be given.

In the case where the apparatus shown in FIG. 4 is connected to the input terminals of the loudspeakers, the cross-talk component of the sound is canceled through the signal processing defined by the following formula (22).

$$\frac{1}{1-k^2*z^{-2n}}\begin{bmatrix}1 & -k*z^{-n}\\ -k*z^{-n} & 1\end{bmatrix}\begin{bmatrix}1 & k*z^{-n}\\ k*z^{-n} & 1\end{bmatrix}=\begin{bmatrix}1 & 0\\ 0 & 1\end{bmatrix} \tag{22}$$

In the above formula (22), the second matrix of the left portion of the formula is the transfer function corresponding to the paths from the left and right loudspeakers to the left and right ears of the listener, while the first matrix of the left portion of the formula (i.e., a portion other than the second matrix) is the inverted matrix of the second matrix.

In this embodiment, the matrix defined in the following formula (23) functions as the first matrix of the left portion in formula (22) and is applied to left and right channel sound signals $L_0$ and $R_0$.

$$\frac{1}{1-m^2*z^{-2n}}\begin{bmatrix}1+i*z^{-2n} & -j*z^{-n}\\ -j*z^{-n} & 1+i*z^{-2n}\end{bmatrix} \tag{23}$$

The sound localization control apparatus shown in FIG. 5 performs the signal processing corresponding to the matrix defined by formula (23). In FIG. 5, the output signal of delay circuit 22a, included in loop circuit 20, is supplied to multiplier 41 and then multiplied by the coefficient −j. The output signal of delay circuit 32b, included in loop circuit 30 is supplied to multiplier 44 and then multiplied by the coefficient i. The output signals of multipliers 41 and 44 are summed by adder 46. The output signals of adders 46 and 31 are summed by adder 16. On the other hand, the output signal of delay circuit 22b included in loop circuit 20 is supplied to multiplier 42 and then multiplied by the coefficient 1. The output signal of delay circuit 32a included in loop circuit 30 is supplied to multiplier 43 and then multiplied by the coefficient −j. The output signals of multipliers 42 and 43 are summed by adder 45. The output signals of adders 45 and 21 are summed by adder 15. The connection configuration of the other elements is similar to that of the corresponding elements shown in FIG. 4.

The relationship between the configuration shown in FIG. 5 and formula (23) is as follows:

The signal processing indicated by the first row and first column element of matrix of formula (23) corresponds to the signal operation in which the output signal of multiplier 42 is supplied to adder 15 via adder 45 and then added with the output signal of loop circuit 20. The signal processing indicated by the second row and second column element of the matrix corresponds to the signal operation in which the output signal of multiplier 44 is supplied to adder 16 via adder 46 and then added with the output signal of loop circuit 30. The signal processing indicated by the first row and second column element of the matrix corresponds to the signal operation in which the output signal of multiplier 41 is supplied to adder 16 via adder 46 whereby added with the output signal of loop circuit 30. The signal processing indicated by the second row and first column element of the matrix corresponds to the signal operation in which the output signal of multiplier 43 is supplied to adder 15 via adder 45 and then added with the output signal of loop circuit 20.

Hereinafter, the operation of the second preferred embodiment will be given. The transfer function emanating from the loudspeakers to the left and right ears of the listener is defined by the following formula (24).

$$\frac{1}{1-m^2*z^{-2n}}\begin{bmatrix}1+i*z^{-2n} & -j*z^{-n}\\ -j*z^{-n} & 1+i*z^{-2n}\end{bmatrix}\begin{bmatrix}1 & k*z^{-n}\\ k*z^{-n} & 1\end{bmatrix}=$$

$$\frac{1}{1-m^2*z^{-2n}}\begin{bmatrix}1+i*z^{-2n}-j*k*z^{-2n} & k*z^{-n}+\\ k*z^{-n}+ & i*k*z^{-3n}-j*z^{-n}\\ i*k*z^{-3n}-j*z^{-n} & 1+i*z^{-2n}-j*k*z^{-2n}\end{bmatrix}$$

In the above matrix, the first row and first column element and the second row and second column element are defined as the following transfer function S.

$$S=(1+i*z^{-2n}-j*k*z^{-2n})/(1-m^2*z^{-2n})=\{1-(j*k-1)*z^{-2n}\}/(1-m^2*z^{-2n}) \tag{25}$$

In the matrix (24), the first row and second column element and the second row and first column element are defined as the following transfer function A.

$$A=(k*z^{-n}+i*k*z^{-3n}-j*z^{-n})/(1-m^2*z^{-2n})=\{(k-j)*z^{-n}+i*k*z^{-3n}\}/(1-m^2*z^{-2n}) \tag{26}$$

Suppose that i and j are selected so as to satisfy the following condition.

$$i=k*(j-k) \tag{27}$$

where $j*k-1=m^2$ and $m=k$

In this case, the transfer function S defined by formula (21) equals 1. Accordingly, the transfer function applied to left and right channel audio signals is regarded as an all pass filter. Thus, the transfer function A defined by formula (26) is rewritten as the following formula (28).

$$\begin{aligned}A&=\{(k-j)*z^{-n}+i*k*z^{-3n}\}/(1-k*k*z^{-2n})=\\ &\{(k-j)*z^{-n}+k*(j-k)*k*z^{-3n}\}/(1-k*k*z^{-2n})=\\ &\{(k-j)*z^{-n}*(1-k*k*z^{-2n})\}/(1-k*k*z^{-2n})=\\ &(k-j)*z^{-n}\end{aligned} \tag{28}$$

In this case, if j=k then A=0, and if j=0 then $A=k*z^{-n}$. Accordingly when j=k, cross-talk components are completely canceled and when j=0, same cross-talk components of these loudspeakers which are driven without signal processing of input signal will always reoccur. In addition, the frequency characteristic of transfer function S can be made equivalent to that of an all-pass filter by setting 1 according to the condition defined by formula (27).

What is claimed is:

1. A method for controlling sound of the sound image which is perceived by a listener, comprising the steps of:

receiving input audio signals of right channel Ri and left channel Li, performing a matrix operation on the input audio signals as described below, the matrix operation being;

$$\begin{bmatrix} Ro \\ Lo \end{bmatrix} = \frac{1}{1 - k^2 z^{-2T}} \begin{bmatrix} 1 & -k*z^{-T} \\ -k*z^{-T} & 1 \end{bmatrix} \begin{bmatrix} Ri \\ Li \end{bmatrix}$$

wherein T is a difference between sound propagation times through cross-talk paths and main paths, said cross-talk paths being two paths crossing each other between said loudspeakers and ears of a listener, said main path being two noncrossing paths between said loudspeakers and said ears, k is a ratio between attenuation for transmitting a sound through said main path and said cross-talk path;

$z^{-T}$ is a delay operator for delaying signals by time T, respectively supplying the output audio signals of the right channel Ro and the left channel Lo which are resulted by the matrix operation to the right and left loudspeakers placed in front of the listener.

2. A method for controlling sound of the sound image which is perceived by a listener, comprising the steps of:

receiving input audio signals of right channel Ri and left channel Li, performing a matrix operation on the input audio signals as described below, $$\begin{bmatrix} Ro \\ Lo \end{bmatrix} = \frac{1}{1 - m^2 z^{-2T}} \begin{bmatrix} 1 + i*z^{-2T} & -j*z^{-T} \\ -j*z^{-T} & 1 + iz^{-2T} \end{bmatrix} \begin{bmatrix} Ri \\ Li \end{bmatrix}$$

wherein i, j and m are determined so that an element at first row and first column and an element at second row and second column are both unity in a resultant matrix produced by multiplying the output audio signals of the right channel Ro and the left channel Lo which are resulted by the above matrix operation with a transfer function matrix defined below, $$\begin{bmatrix} 1 & k*z^{-T} \\ k*z^{-T} & 1 \end{bmatrix}$$

respectively supplying the output audio signals of the right channel Ro and the left channel Lo to right and left loudspeakers placed in front of the listener.

3. Sound localization control apparatus comprising:

input terminals for receiving left and right channel audio signals;

a first operation circuit including first means for delaying by a first delay amount, and first means for amplifying by a predetermined amount, the left channel audio signal;

a second operation circuit including second means for delaying by said first delay amount, and second means for amplifying by said predetermined amount, the right channel audio signal;

a first adder for adding the left channel audio signal with an output signal of the second operation circuit;

a second adder for adding the right channel audio signal with an output signal of the first operation circuit;

a first loop circuit including an amplifier and a first delay circuit having a delay of twice said first delay amount whereby an output signal of said first adder is entered and circulated and a circulating signal is supplied to a left loudspeaker; and a second loop circuit including an amplifier and a second delay circuit having a delay of twice said first delay amount whereby an output signal of said second adder is entered and circulated and a circulating signal is supplied to a right loudspeaker.

4. Sound localization control apparatus comprising:

input terminals for receiving left and right channel audio signals;

a first loop circuit including a first amplifier and a first delay circuit whereby the left channel audio signal is entered and circulated and output as a first output signal and a first plurality of phase delayed signals having different phase from each other are provided;

a second loop circuit including a second amplifier and a second delay circuit whereby the right channel audio signal is entered and circulated and output as a second output signal and a second plurality of phase delayed signals having different phase from each other are provided;

means for receiving and amplifying said first plurality of phase delayed signals and providing first phase delayed output signals;

means for receiving and amplifying said second plurality of phase delayed signals and providing second phase delayed output signals;

first mixing means for mixing one of the first phase delayed output signals of the said first loop circuit and one of the second phase delayed output signals of said second loop circuit which have different phase from each other and providing a first mixed signal, combining the first mixed signal with said first output signal and outputting the result to a left loudspeaker; and second mixing means for mixing the other of said first phase delayed output signals of said first loop circuit and the other of said second phase delayed output signals of said second loop circuit which have different phase from each other and providing a second mixed signal, combining the second mixed signal with said second output signal and outputting the result to a right loudspeaker.

5. A sound image control apparatus comprising:

means for receiving input audio signals of right channel Ri and left channel Li, means for performing a matrix operation on the input audio signals as described below, the matrix operation being;

$$\begin{bmatrix} Ro \\ Lo \end{bmatrix} = \frac{1}{1 - k^2 z^{-2T}} \begin{bmatrix} 1 & -k^* z^{-T} \\ -k^* z^{-T} & 1 \end{bmatrix} \begin{bmatrix} Ri \\ Li \end{bmatrix}$$

wherein T is a difference between sound propagation times through cross-talk paths and main paths, said cross-talk paths being two paths crossing each other between said loudspeakers and ears of a listener, said main path being two noncrossing paths between said loudspeakers and said ears;

k is a ratio between attenuation for transmitting a sound through said main path and said cross-talk path; and $z^{-T}$ is a delay operator for delaying signals by time T, and means for respectively supplying the output audio signals of the right channel Ro and the left channel Lo which result from the matrix operation to the right and left loudspeakers placed in front of the listener.

6. A sound localization control apparatus comprising:

means for receiving input audio signals of right channel Ri and left channel Li, means for performing a matrix operation on the input audio signals as described below, $$\begin{bmatrix} Ro \\ Lo \end{bmatrix} = \frac{1}{1 - m^2 z^{-2T}} \begin{bmatrix} 1 + i^* z^{-2T} & -j^* z^{-T} \\ -j^* z^{-T} & 1 + i z^{-2T} \end{bmatrix} \begin{bmatrix} Ri \\ Li \end{bmatrix}$$

wherein i, j and m are determined so that an element at first row and first column and an element at second row and second column are both unity in a resultant matrix produced by multiplying the output audio signals of the right channel Ro and the left channel Lo which result from the above matrix operation with a transfer function matrix defined below, $$\begin{bmatrix} 1 & k^* z^{-T} \\ k^* z^{-T} & 1 \end{bmatrix}$$

and means for respectively supplying the output audio signals of the right channel Ro and the left channel Lo to right and left loudspeakers placed in front of the listener.

7. A sound field control apparatus, comprising:

first and second input terminals for receiving left and right audio signals, respectively;

first loop circuit means, including first and second delay circuits and a first amplifying circuit coupled in series, for receiving said left audio signal, circulating it and providing the circulating signal as a first output signal and for providing the output of the first delay circuit as a second output signal;

second loop circuit means, including third and fourth delay circuits and a second amplifying circuit coupled in series, for receiving said right audio signal, circulating it and providing the circulating signal as a third output signal and for providing the output of the third delay circuit as a fourth output signal;

a third amplifier for acting on said second output signal;

a fourth amplifier for acting on said fourth output signal;

first combining means for combining the output of said fourth amplifier and said first output signal and providing a first combined output signal to a left loudspeaker; and second combining means for combining the output of said third amplifier and said third output signal and providing a second combined output signal to a right loudspeaker.

8. A sound field control apparatus as set out in claim 7, wherein said first, second, third and fourth delay circuits delay the respective circulating signals by the same amount.

9. A sound field control apparatus as set out in claim 7, wherein said first and second amplifying circuits amplify the respective circulating signals by the same amount.

* * * * *